US006603429B1

(12) United States Patent
Bancroft et al.

(10) Patent No.: US 6,603,429 B1
(45) Date of Patent: Aug. 5, 2003

(54) MULTI-BAND PLANAR ANTENNA

(75) Inventors: Randy C. Bancroft, Denver, CO (US); Kenneth T. Lawson, Jr., Lafayette, CO (US); Michael D. Zinanti, Wheat Ridge, CO (US); Shanna Carroll French, Morrison, CO (US); Blaine R. Bateman, Louisville, CO (US)

(73) Assignee: Centurion Wireless Tech., Inc., Lincoln, NE (US)

( * ) Notice: Subject to any disclaimer, the term of this patent is extended or adjusted under 35 U.S.C. 154(b) by 0 days.

(21) Appl. No.: 10/082,030

(22) Filed: Feb. 21, 2002

(51) Int. Cl.[7] ..... H01Q 1/38
(52) U.S. Cl. ..... 343/700 MS
(58) Field of Search ..... 343/700 MS, 846, 343/829, 830

(56) References Cited

U.S. PATENT DOCUMENTS

| | | | | |
|---|---|---|---|---|
| 6,157,344 | A | 12/2000 | Bateman et al. | 343/700 MS |
| 6,249,254 | B1 | 6/2001 | Bateman et al. | 343/700 MS |
| 6,307,525 | B1 | 10/2001 | Bateman et al. | 343/700 MS |

*Primary Examiner*—Michael C. Wimer
(74) *Attorney, Agent, or Firm*—Holland & Hart

(57) ABSTRACT

A compact, multi-band planar antenna for wireless communication devices is disclosed and which comprises a dielectric substrate having a first radiating element formed on one side thereof. The radiating element has a triangular shape and has an opening formed therein. A ground plane element is formed on the other side of the substrate. Various embodiments of the antenna are also disclosed.

11 Claims, 1 Drawing Sheet

MULTI-BAND PLANAR ANTENNA

BACKGROUND OF THE INVENTION

1. Field of the Invention

This invention relates to a multi-band planar antenna for wireless communication devices and relates specifically to a multi-band planar antenna which is compact and which does not require additional cabling or connections to the transmitter/receiver.

2. Description of the Related Art

For a given physical size and set of antenna performance parameters, such as gain and antenna pattern, multi-band antennas have often been of lower performance than single band antennas of the same size, or conversely have been physically larger than single band antennas of the same performance. Additionally, multi-band antennas have often been more complex in structure than single-band antennas, hence multi-band antennas have been of higher cost than single band antennas. In many cases where multi-band antennas have been applied the multi-band antenna impedance characteristic is not matched to 50 ohms at all the desired bands, hence requiring a matching network to be used in conjunction with the multi-band antenna. In many applications, a multi-band antenna is desired of the same size, cost, and simplicity of a single-band antenna. The need for planar antennas has been well-described in U.S. Pat. Nos. 6,157,344, 6,249,254 and 6,037,525. Thus, there is a need for planar, multi-band antennas which have the advantages of a planar antenna such as in the '344 patent but that operates at two or more frequencies and are no larger than the antenna of the '344 patent. In particular, the telematics market desires a dual-band antenna for the two primary network frequencies (e.g., 860 MHz [AMPS] and 1920 MHz [PCS]).

U.S. Pat. No. 6,307,525 pertains to a multi-band antenna which combines elements of a design of U.S. Pat. Nos. 6,157,344 and 6,249,254 with a multiplexer capable of separating the RF energy based on frequency. While the antenna of the '525 patent performs exceedingly well and has been successfully commercialized, it is relatively large and in general is larger than the area of the antennas which it replaces.

Further, the introduction of the multiplexer circuit introduces some losses which reduce the gain of the antenna in the '525 patent, and in some cases, the patterns of the antenna radiation are affected by the presence of the multiplexer. The main advantage of the antenna in the '525 patent is the single port and the planar shape thereof.

SUMMARY OF THE INVENTION

A compact, multi-band planar antenna is provided which consists of a substrate having opposite sides with the substrate comprising a commercial PCB laminate. A ground plane is formed on one side of the substrate by known PCB processing techniques. On the other side of the substrate, an antenna element or radiating element is formed by the same processing technique. The shape of the antenna element is generally triangular in shape with a feed point being provided at the apex thereof. An opening or cut-out portion is formed in the antenna element which provides for a multiplicity of current paths giving rise to the multi-banding characteristics of the invention. In some embodiments, a second ground plane is formed on the substrate on the same side as the antenna element. In some embodiments, a matching network is formed on the substrate which is connected to the feed point of the antenna element in order to increase the bandwidth of the antenna or to improve the impedance matching. In some embodiments wherein a matching network is utilized, the matching network is comprised of a network of microstrip transmission lines with the ground plane being utilized as the ground plane side of the transmission lines. In some embodiments, the opening formed in the antenna element is modified by partially filling it with a second antenna element.

In the present invention, the advantages of the antenna of the '525 patent are maintained, but the size is similar to the antenna as described in the '344 and '254 patents operating at the lowest of the multi-band frequencies. Therefore, in the present invention, the advantages of the antenna of the '344 patent and the '254 patent are fully retained without additional size, cost, or manufacturing difficulty, with additional frequencies of operation being created with similar pattern and gain characteristics of the antenna of the '344 and '254 patents.

It is therefore a principal object of the invention to provide an improved multi-band antenna.

A further object of the invention is to provide a compact, multi-band planar antenna.

Yet another object of the invention is to provide a multi-band planar antenna which does not require additional cabling or connections to the transmitter/receiver of the wireless communication device.

Still another object of the invention is to provide a compact, multi-band planar antenna which has satisfactory gain performance.

Still another object of the invention is to provide a planar antenna which permits multi-banding in any application which can be served by a single band antenna according to the '344 patent.

Still another object of the invention is to provide an antenna of the type described which may be modified in order to alter the operating frequency, improve the bandwidth, or otherwise modify the performance characteristics of the antenna.

These and other objects will be apparent to those skilled in the art.

DETAILED DESCRIPTION OF THE EMBODIMENTS

Figure 1A:
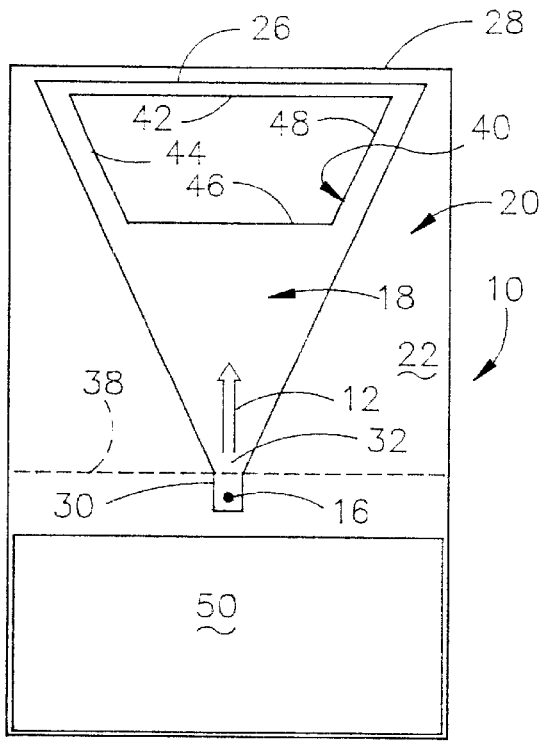
FIG. 1A is a radiating element view of an antenna in accordance with this invention wherein a protective coating has not been applied, and wherein the long axis of the antenna is shown by an arrow.
Figure 1B:
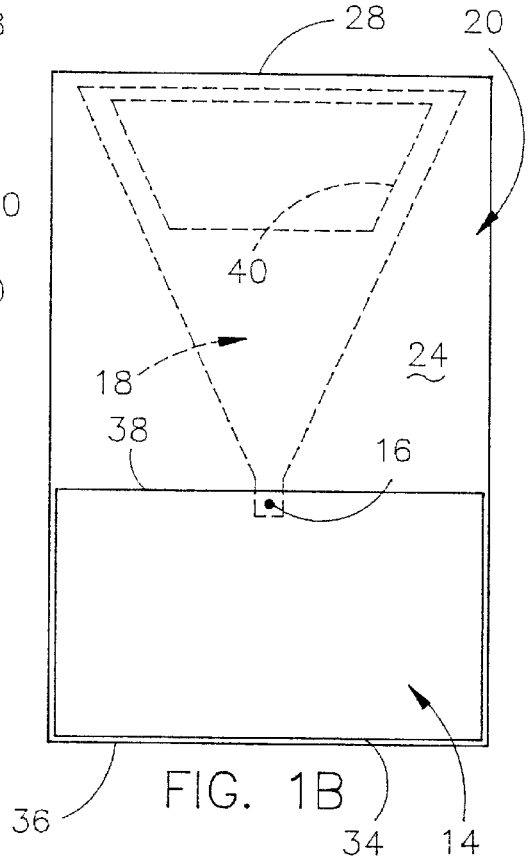
FIG. 1B is a ground plane view of the antenna of FIG. 1A.

FIG. 1A is a top view, i.e., a view from the radiating element side, of an antenna 10 in accordance with this invention. The antenna 10 is similar to the flat panel antenna described in U.S. Pat. No. 6,157,344 which is owned by the assignee of the instant invention. The antenna of U.S. Pat. No. 6,157,344 is generally the same type of antenna as disclosed herein except for the fact that the antennas disclosed herein are multi-band antennas. U.S. Pat. No. 6,249, 254 describes the method of making the invention of the '344 patent. The disclosure of U.S. Pat. Nos. 6,157,344 and 6,249,254 are incorporated herein by reference. Antenna 10 has a centrally located long axis as shown by arrow 12. FIG. 1B is a bottom view, i.e., a view from the ground plane element side, of an antenna 10. In one embodiment, a co-axial feed cable (not shown) would be operatively connected to the antenna ground plane element 14 formed on the ground plane side of the antenna 10 with the centrally located feed conductor thereof being operatively connected to the antenna by passing the feed conductor through the opening 16 and connecting it to the feed line 30 in such a way as to prevent the feed conductor from shorting to ground plane 14. In another embodiment, the co-axial feed cable may be replaced by a suitable co-axial connector which is attached to the ground plane side of antenna 10 and has a center conductor which passes through opening 16 and is operatively connected to feed line 30. In yet another embodiment, the feed line 30 may be extended by the addition of a transmission line formed on the same side of the substrate as the antenna element 18, with the feed line then running to the edge of the substrate 28 or a co-axial connector may be operatively connected to the feed line and to the ground plane 14. Other suitable connection schemes may be envisioned by those skilled in the art. The ground plane element 14 is electrically connected to the radiating element 18.

Without limitation thereto, in an embodiment of the invention, antenna 10 is formed from a relatively thin glass epoxy rigid laminate substrate 20. Substrate 18 is comprised of a commercial PCB laminate such as 0.030 FR4 or other materials as may be suited for the particular application. The top and bottom flat surfaces 22 and 24 of substrate 18 carry a thin layer, coating, or film of a metal such as copper. Copper-clad substrate 20 is processed, for example, by using well-known masking and etching techniques, to provide (1) a first metal pattern on the FIG. 1A side of the substrate 20, this first metal pattern comprising the triangular-shaped metal radiating element 18 whose base 26 is positioned coincident with, or closely adjacent to, a first side edge or edge surface 28 of substrate 20, and to provide a metal feed line 30 that extends from the apex 32 of the triangle, and to provide (2) a second metal pattern on the FIG. 1B side of the substrate 20, the second pattern comprising the metal ground plate element 14 having a first edge 34 that is positioned coincident with, or closely adjacent to, the second side edge or edge surface 36 of substrate 20, and having a second edge 38 that dimensionally overlaps a portion of feed line 30 but does not overlap radiating element 18.

In a preferred embodiment of the invention, but without limitation thereto, substrate 20 is a rectangle, with radiating element 18 being formed as a triangle having two equal length sides that join to form apex 32 and having a base that is equal or unequal in length to the sides, thus placing apex 32 coincident with the antenna long axis 12. In the preferred embodiment, feed line 30 is formed as a centrally located rectangle coincident with the antenna long axis 12 with one end of feed line 30 coincident with the apex 32 of the triangular-shaped radiating element 18, and with the other end of feed line 30 spaced from the substrate second side edge or edge surface 36. In the preferred embodiment, ground plane element 14 is formed as a rectangle.

Figure 1C:
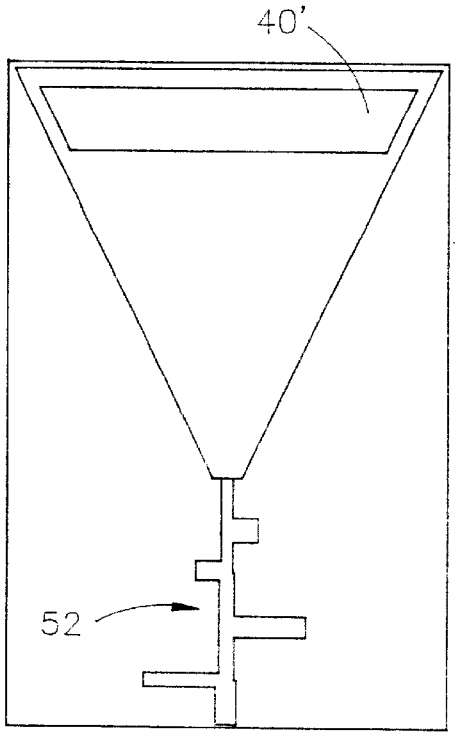
FIG. 1C is a radiating element view of a modified form of the antenna of this invention.

In the antenna of this invention, the antenna of Centurion Wireless Technologies, Inc. as disclosed in U.S. Pat. No. 6,157,344 is modified by the addition of one or more openings in the metal portion of the primary antenna element. These openings are located in a region known to have minimal currents at resonance in the '344 antenna, as has been demonstrated by simulation. The size of the openings in the z axis of the antenna is chosen such that the lower edge of the opening defines a new triangle within the existing antenna with the known '344 triangular antenna geometry at higher frequencies. In this way, a multi-band antenna is created in the same physical size as the original single band antenna without addition of any components. As seen in the drawings, the opening 40 is generally trapezoidal in shape and includes sides 42, 44, 46 and 48 with side 42 being located adjacent end edge 14 of substrate 12. FIG. 1C illustrates a slightly smaller opening 40' than the opening 40 in FIG. 1A.

Figure 1D:
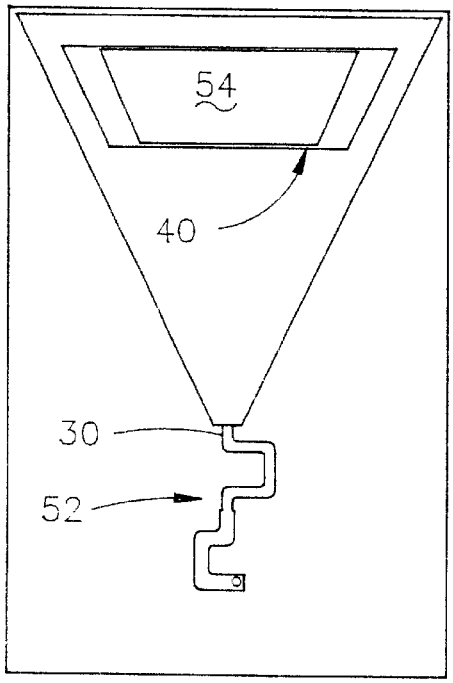
FIG. 1D is a radiating element view of a further embodiment of the invention.

In some embodiments, a second ground plane 50 is formed on side 22. In some embodiments, a matching network 52 is formed on the substrate 20 which is connected to the feed line 30 of radiating element 18 in order to increase the bandwidth of the antenna or improve the impedance matching where the antenna is connected to a fifty ohm feed line. In some embodiments utilizing matching networks, the matching network 52 is made up of a network of microstrip transmission lines with the ground plane 14 being utilized as the ground plane side of the transmission line. In some embodiments, the opening 40 is modified as illustrated in FIG. 1D by partially filling it with a passive radiating element 54 in order to alter the operating frequency, improve the bandwidth, or otherwise modify the performance characteristics of the antenna.

It can therefore be seen that a unique compact, multi-band planar antenna has been provided which accomplishes at least all of its stated objectives. The antenna of this invention permits a single antenna to be used for multiple bands without additional cabling or connections to the transmitter/receiver. In cases where multiple carriers desire to connect to one system, such as a multi-carrier in-building voice system, the use of one multi-band antenna replicated n times may permit economics of scale for the single part number rather than two or three or n separate parts for the various frequencies. Using the approach of this invention for telematics applications allows a smaller antenna to be used than the integrated diplexer approach. This advantage is critical for on-glass and stealth antennas which must be as small as possible.

Thus it can be seen that the invention accomplishes at least all of its stated objectives.

We claim:

1. A multi-band planar antenna, comprising:

a flat dielectric substrate having a first surface, a second surface that is generally parallel to said first surface, a first edge, and a second edge which is located generally opposite said first edge;

a first triangular-shaped metal radiating element on said first surface, said radiating element having a triangle apex which is formed by the intersection of two linear triangle sides, and said radiating element having a linear triangle base at whose opposite ends said triangle base being located generally adjacent to said first edge;

a metal feed line including and formed as an extension of said triangle apex, said feed line extending in a direction away from said triangle base and extending from said triangle apex toward said second edge of said substrate;

a metal ground plane element on said second surface, said ground plane element having a first edge located generally adjacent to said second edge of said substrate; and said ground plane element having a second edge that dimensionally overlaps said feed line and only said apex of said radiating element;

said ground plane element being electrically connected to said radiating element;

said radiating element having at least one opening formed therein, thereby providing a multiplicity of current paths which give rise to the multi-banding characteristics of the antenna.

2. The multi-band planar antenna of claim 1 wherein said substrate has a second ground plane element on said first surface.

3. The multi-band planar antenna of claim 1 wherein said opening in said radiating element is trapezoidal in shape.

4. The multi-band planar antenna of claim 3 wherein said trapezoidal-shaped opening has a pair of sides which are generally parallel to said two sides of said radiating element, respectively.

5. The multi-band planar antenna of claim 1 wherein said opening in said radiating element is partially filled by another radiating element which is not connected to said first radiating element.

6. The multi-band planar antenna of claim 3 wherein said trapezoidal-shaped opening is partially filled by a passive element which is coupled to said first radiating element.

7. The multi-band planar antenna of claim 6 wherein said passive radiating element is trapezoidal in shape.

8. The multi-band planar antenna of claim 1 wherein a matching network is formed on said substrate and is connected to said feed line of said first radiating element.

9. The multi-band planar antenna of claim 8 wherein said matching network comprises a network of microstrip transmission lines.

10. The multi-band planar antenna of claim 9 wherein said ground plane element is utilized as the ground plane of said microstrip transmission lines.

11. The multi-band planar antenna of claim 1 wherein said opening in said first radiating element has a lower edge which defines a second planar triangular-shaped radiating element within said first radiating element.

* * * * *